US005520131A

United States Patent [19]

Goldbach

[11] Patent Number: 5,520,131

[45] Date of Patent: May 28, 1996

[54] APPARATUS AND METHOD FOR ACCOMMODATING LEAKED OIL WITHIN A DOUBLE-HULLED TANKER AFTER SUFFERING GROUNDING DAMAGE

[75] Inventor: Robert D. Goldbach, Millford, N.J.

[73] Assignees: Metro Machine Corp., Norfolk, Va.; Marinex International, Inc., Hoboken, N.J.

[21] Appl. No.: 264,152

[22] Filed: Jun. 22, 1994

[51] Int. Cl.[6] ..... B63B 25/08

[52] U.S. Cl. ..... 114/74 A; 114/65 R

[58] Field of Search ..... 114/74 R, 74 A, 114/65 R, 125

[56] References Cited

U.S. PATENT DOCUMENTS

| | | | |
|---|---|---|---|
| 3,832,966 | 9/1974 | Garcia | 114/74 R |
| 5,086,722 | 2/1992 | Sloope et al. | 114/74 R |
| 5,158,031 | 10/1992 | Arnett et al. | 114/74 R |

FOREIGN PATENT DOCUMENTS

| | | | |
|---|---|---|---|
| 92010396 | 6/1992 | WIPO | 114/125 |

*Primary Examiner*—Sherman Basinger

*Attorney, Agent, or Firm*—Cushman Darby & Cushman

[57] ABSTRACT

A double-hull tanker having one or more cargo tanks is structured so as to have compartments surrounding each cargo tank in the form of between inner and outer hulls, and possibly between cargo tanks. These surrounding compartments are normally empty when the tanker is carrying a cargo of oil, or a similar largely water immiscible, lighter-than-water flowable liquid cargo. The volume of the cargo tank or tanks above a level equal to 111 percent of the assigned draft (Vc) of the vessel, is less than the volume of that cargo tank's surrounding compartments below that same level (Va). Because the hydrostatic equilibrium level for typical specific gravity ranges of crude oil and seawater is at least 111 percent of a vessel's maximum allowable operating draft, the compartments provide sufficient volume to contain all oil which might leak from a cargo tank during grounding damage.

5 Claims, 4 Drawing Sheets

APPARATUS AND METHOD FOR ACCOMMODATING LEAKED OIL WITHIN A DOUBLE-HULLED TANKER AFTER SUFFERING GROUNDING DAMAGE

BACKGROUND OF THE INVENTION

Double-hull tankers, when loaded with oil cargo, contain that cargo within one or more cargo tanks which are separated from the tanker's side and bottom shell plating by double-hull compartments. These double-hull compartments are typically empty when cargo is being carried and are filled with water ballast during voyages when no cargo is on board. When cargo oil is being carried, the level of oil in the cargo tanks can extend as high as the underside of the vessel's upper deck, and the level of seawater outside the vessel's hull can extend as high as the vessel's allowed operating draft. When the vessel sustains bottom damage to its outer and inner hulls from grounding, and that damage extends vertically upward into a cargo tank, according to the laws of physics, the level of oil in the cargo tank will lower until it is in hydrostatic equilibrium with the level of seawater outside the ship. Until this point of equilibrium is reached, the oil will first fill any otherwise empty adjoining double-hull compartment to a level that is in hydrostatic equilibrium with the seawater outside the ship. Any oil remaining in the cargo tank above the equilibrium level of oil in the double hull compartment will escape outside the vessel and cause an oil spill. The amount of oil which will so escape is dependent on the distance between oil and seawater levels before damage occurred, the specific gravity of the oil cargo (typically 0.85–0.90 for most crude oils) compared to the specific gravity of seawater (typically 1.000–1.025), and the volume of the double hull compartment below the oil equilibrium level.

Although the apparatus and method of the present invention could be used in connection with many different designs of double-hulled tankers, it is believed to be particularly useful in conjunction with the double-hulled tanker constructions which are shown and described in the following documents:

| U.S. Patents | | |
|---|---|---|
| Patentee | U.S. Pat. No. | Issue Date |
| Tornay | 4,638,754 | January 27, 1987 |
| Cuneo et al. | 5,085,161 | February 4, 1992 |
| Goldbach et al. | 5,090,351 | February 25, 1992 |
| Goldbach et al. | 5,086,723 | February 11, 1992 |
| Goldbach et al. | 5,269,246 | December 14, 1993 |
| **U.S. Patent Applications** | | |
| Inventor(s) | Application No. | Filing Date |
| Goldbach | 07/953,141 | September 29, 1992 |
| Goldbach | 08/033,357 | March 18, 1993 |
| Goldbach et al. | 08/095,178 | July 23, 1993 |

(now, respectively, U.S. Pat. No. 5,320,055, issued Jun. 14, 1994, U.S. Pat. No. 5,293,830, issued Mar. 15, 1994, and U.S. Pat. No. 5,313,903, issued May 24, 1994).

SUMMARY OF THE INVENTION

A double-hull tanker having one or more cargo tanks is structured so as to have compartments surrounding each cargo tank in the form of compartments between inner and outer hulls, and possibly between cargo tanks. These surrounding compartments are normally empty when the tanker is carrying a cargo of oil, or a similar largely water immiscible, lighter-than-water flowable liquid cargo. The volume of the cargo tank or tanks above a level equal to 111 percent of the maximum allowed operating draft (Vc) of the vessel, is less than the volume of that cargo tank's surrounding compartments below that same level (Va). Because the hydrostatic equilibrium level for typical specific gravity ranges of crude oil and seawater is at least 111 percent of a vessel's maximum allowed operating draft, the compartments provide sufficient volume to contain all oil which might leak from a cargo tank during grounding damage.

The invention relates to the geometry of the intact ship and the maximum allowable draft of the ship at the time of the accident. After breaching of a cargo tank, the level of the oil in the tank and in the space surrounding the tank will equalize, but this equalized level will be higher than the seal level outside the ship by an amount no less than 11 percent of the ship's initial draft before damage because of the relative lower specific gravity of the oil. This is true whether there is an egress of seawater, a loss of oil to the sea, or a situation when neither of these happens. Therefore, if the volume of a cargo tank above a level equal to 111 percent of the maximum allowable draft is less than the volume below that level of the space into which oil would flow, no matter what configuration that space has, the oil will be retained in that space as long as it has a specific gravity less than 0.9.

The principles of the invention will be further discussed with reference to the drawing wherein a preferred embodiment is shown. The specifics illustrated in the drawing are intended to exemplify, rather than limit, aspects of the invention as defined in the claims.

DETAILED DESCRIPTION

Figure 1:
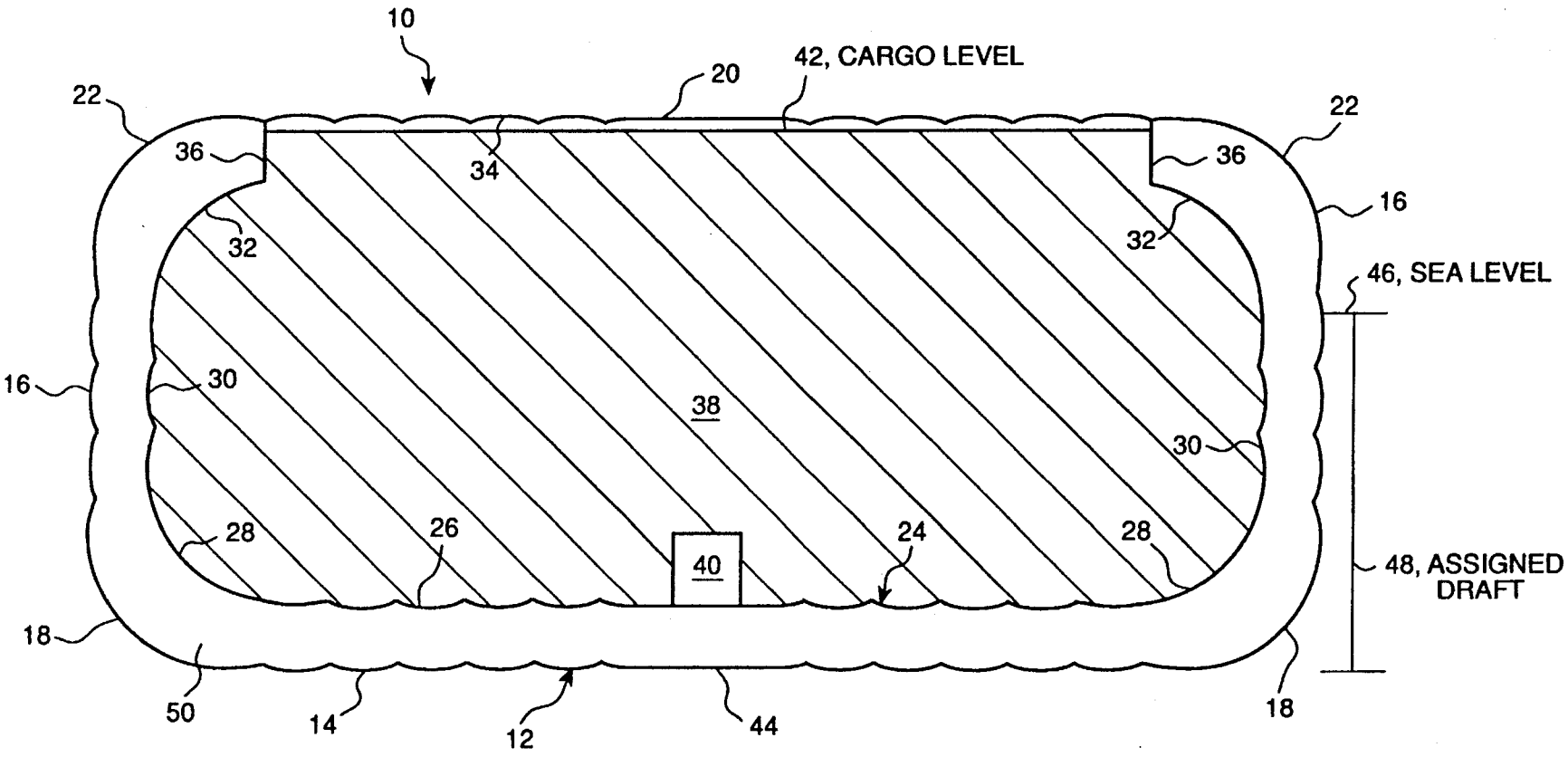
FIG. 1 is a schematic transverse cross-sectional view of a conventionally proportioned double-hulled oil tanker fully loaded with cargo, afloat in the sea, and having its cargo tank-surrounding interhull compartments normally empty.

In FIG. 1, there is shown in transverse cross-section, at a midbody location, a double-hulled liquid cargo vessel 10, for instance, a very large crude carrier designed for transporting crude oil. In fact, the principles of the invention pertain as well to smaller vessels, the principal criterion, in terms of normal intended use, being that the vessel's cargo tank or tanks carry a liquid which is lighter than, and not very miscible in water.

For convenience in description, any such vessel will be referred to herein as an "oil tanker", despite the fact that it may actually be carrying a partly or fully refined or residual petroleum product, or another bulk liquid such as seed oil, or different products in various ones of its cargo tanks, rather than all crude oil.

A typical oil tanker has a bow section, a stern section, and a longitudinal midbody extending longitudinally between and interconnecting the bow and stern. All, or most, of the oil is carried in one or more cargo tanks all, or most, of which are located in the longitudinal midbody. The oil tanker likely further includes one, or more, tanks for carrying other liquids, including fuel for its own engines.

Some oil tankers have only one plate thickness separating the cargo tank or tanks, and the ocean in which the tanker is afloat. However, others, including many newer ones, and ones still on the drawing boards, have two plate thicknesses separating the cargo from the ocean, namely an inner set of plates which are integrated into an inner hull and have one face forming the defining surface of a cargo tank, and an outer set of plates which are integrated into an outer hull and have one face forming an interface with the external environment of the vessel, i.e., with the ocean and the atmosphere.

In some double-hull (also called double-hulled) tankers, the entire hull has two thicknesses of plates. In others, only the midbody is double hulled, and, in some, only the bottom, or the bottom and bilge are double hulled.

The present invention, particularly, relates to double-hulled tankers in which not only the bottom and bilges, but the side walls (and, optionally, outer peripheral margins of the deck) are of double-hulled construction, throughout at least a part of the vessel that encloses one or more cargo tanks of the vessel.

In a double-hulled vessel, it would be unusual for the inner and outer hulls to be disposed in facewise contact except, perhaps, in regions of transition from single to double-hull construction or vice versa. Rather, it is conventional in double-hull construction for there to be transverse (i.e., central-to-peripheral direction) spacing between the hulls. Also, in most conventional double-hulled tankers, there is a multiplicity of widely distributed stiffening, bracing, mounting and support structures which extend between and structurally interconnect the inner and outer hulls. The U.S. patent and applications enumerated in the Background section, hereinabove, particularly relate to double-hull designs in which most of that interhull structure is provided in the form of longitudinal ribs, with a minimum of transverse hull-interconnecting structure (and that principally or exclusively in the form of transverse bulkheads). Typically (except where certain of the ribs and/or transverse bulkheads define partitions that divide the interhull space into plural compartments), the interhull structure is provided as stiffener plates having lightening holes through them, and/or as a network of skeletal structures.

At least one of the above-enumerated prior art documents, namely Goldbach et al. U.S. Pat. No. 5,086,723, discloses a double-hulled vessel construction in a preferred form of which not only is the space between the hulls divided into compartments by transverse bulkheads, but also, one or more longitudinal bulkheads divide one or more of the cargo tank spaces into two or more side-by-side cargo tanks. One or more of those longitudinal bulkheads is itself of double-walled construction and the interwall space thereof (e.g., extending from its left wall to its right wall, and from one transverse bulkhead to the next, and from the underside of the deck, down to the bottom of the inner hull, and through the inner hull wall of the tanker bottom) is contiguous with a respective between-hulls compartment and forms a functionally integral portion thereof.

Figure 2:
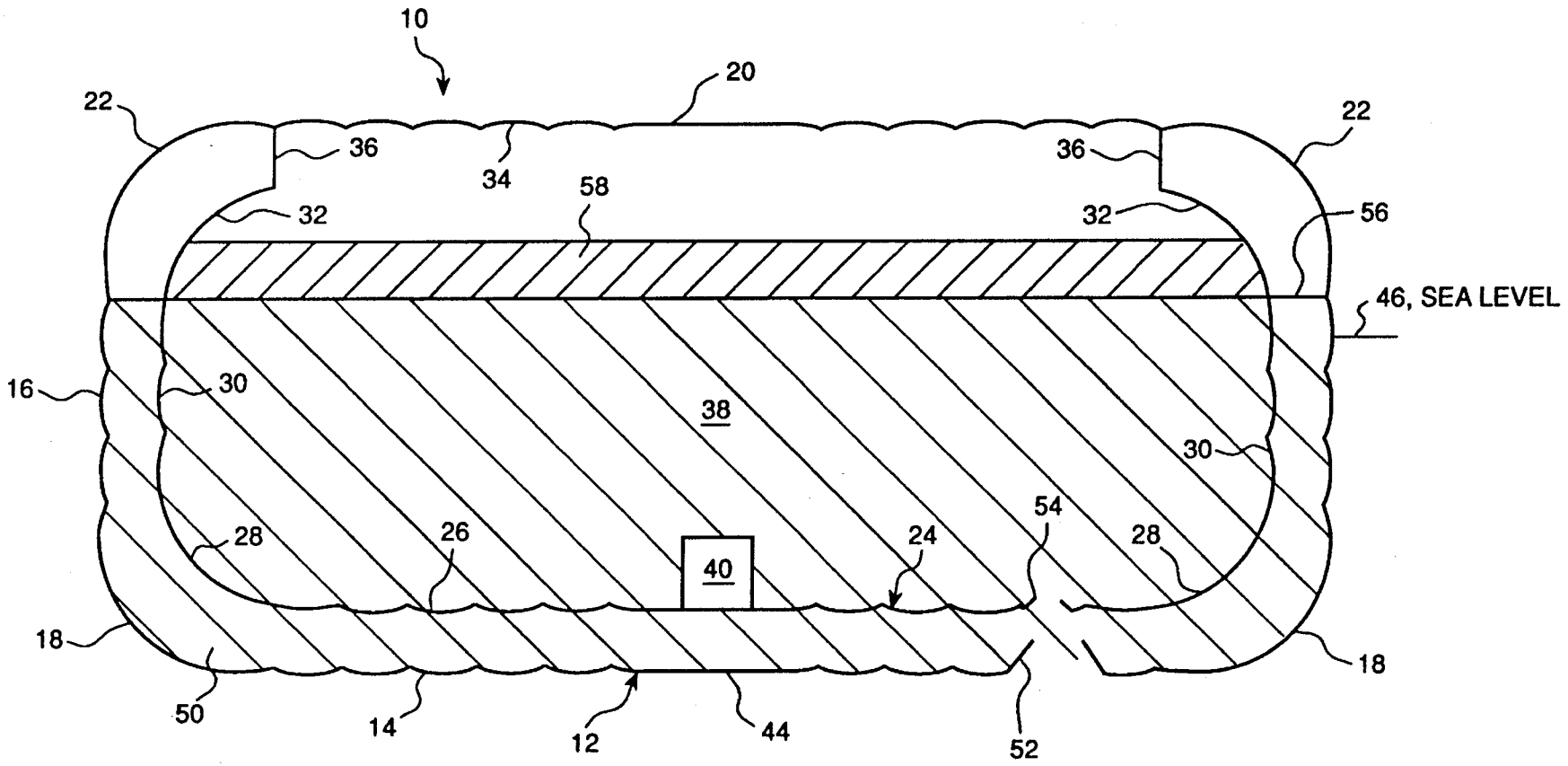
FIG. 2 is a schematic cross-sectional view similar to FIG. 1, showing breaching of the cargo tank through the bottom of the outer and inner hulls, causing some of the cargo of oil to leak into the compartments, the volume of oil which can be expected to spill being distinctively indicated.
Figure 3:
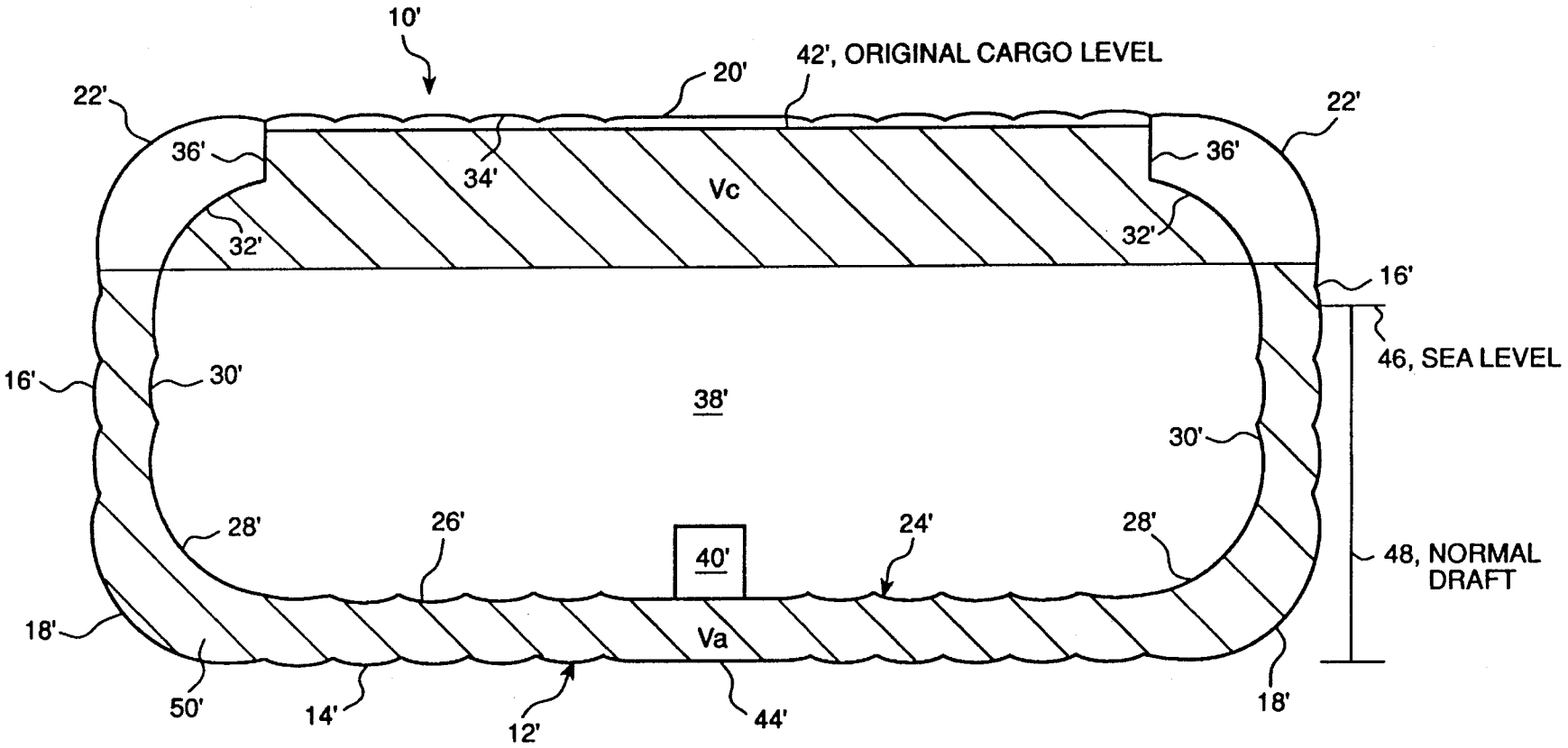
FIG. 3 is a similar schematic transverse cross-sectional view of a double-hulled oil tanker constructed and proportioned in accordance with principles of the present invention, such that upon broaching of the bottom of the inner and outer hulls, sufficient correctly placed volume is available in the cargo tank-surrounding compartment thereby opened, to accommodate substantially all of the oil which can be expected to leak from the broached cargo tank.

With the above facts in mind, the manner in which FIGS. 1–3 are schematic, rather than detailed representations, should be apparent to those of ordinary skill in the art. (E.g., plate thicknesses are not shown.) Although, in the drawing figures, the hull plates are shown being individually curved, as they are in most of the above-enumerated prior art, in fact, some or all of them could be flat, e.g., as they are in at least Goldbach, 08/033,357 (now U.S. Pat. No. 5,293,830, issued Mar. 15, 1994).

In FIG. 1, the double-hulled oil tanker 10 is shown having an outer hull 12 which includes a bottom wall 14, sidewalls 16, joined to the bottom at lower radiused corners 18, and a deck 20, joined to the sidewalls 16 at upper radiused corners 22. The double-hulled tanker 10 further includes an inner hull 24 having a bottom wall 26 (which is spaced above the outer hull bottom wall 14), radiused lower corners 28, sidewalls 30 (ranked spacially more medially than the respective outer hull sidewalls 16), and radiused upper corners 32 (which extend under outer peripheral margins of the deck 20). In the example depicted, the central part of the deck is only single hulled, in this instance by a portion 34 of the outer hull. At the sites of transition from double to single-hull construction, interhull partitions are shown provided at 36.

Accordingly, at least one cargo tank 38 is formed within the inner hull, from the bottom, up to the underside of the central portion 34 of the outer hull, out to the sidewalls inner hull sidewalls 30, corners 28 and 32, and transitional walls 36.

The feature suggested at 40 as a medial, longitudinal intrusion into the cargo tank 38 is a keel tunnel, e.g., for accommodating piping, communications, power and possibly a walkway for inspection and maintenance. Provision of such a feature is a conventional design option. In some instances, keel tunnels are provided between hulls, rather than inside the inner hull. The location shown is preferred in the context of the present invention.

When in use, the cargo tank or tanks 38 of the vessel 10 are maximally filled (so that the cargo level 42 is at, or laps at the underside of the central portion 34 of the deck 20, as shown in FIG. 1, and the vessel 10 is afloat in a sea, for a given vessel the draft is the vertical distance, e.g., measured alongside a sidewall of the outer hull, from the lowermost feature of the bottom wall 14 of the outer hull 12 (at 44), up to sea level (at 46). To the extent that this distance is ascertainable from design considerations, from field trials, or by reference to regulatory rules applicable to such vessels, the draft, which is effectively applicable, is usually termed the vessel's "maximum allowable operating draft" (indicated by the numeral 48). In fact, the temperature of the cargo, its specific gravity, the local salinity of the sea, its temperature, the speed with which the vessel gains and loses heat, and similar factors familiar to those skilled in the art, affect how low a given vessel will ride in the water when laden with a given weight of crude oil. In general, these factors are taken into account in a standard way in order to arrive at a minimum allowable operating draft for a vessel, so that the "maximum allowable operating draft" is ascertainable for any given vessel, and so has an agreed meaning to those of ordinary skill in the art.

In the tanker 10 shown in the drawings, at least part of the space 50 confined between the inner and outer hulls (and possibly between left and right walls of longitudinal bulkheads, not shown) wraps in a gunwales-to-keel direction around at least one cargo tank 38 and, thereby, provides an interhull compartment associated with that cargo tank.

In double-hulled tankers, it is not an uncommon practice to have the interhull, cargo tank-associated compartment or compartments full of water (e.g., seawater) when the associated cargo tank is empty, for ballasting the vessel (so that it does not ride unstably too high in the water when unladen), and pumped empty when the associated cargo tank is filled (so that the vessel does not ride unstably too low in the water when laden).

As indicated with reference to FIG. 1, in a conventionally designed and proportioned double-bottom tanker, when the vessel is fully laden with oil and its ballast tanks are empty, some of the cargo tank-associated interhull compartment space is located above sea level, and some is located below sea level.

If the fully laden, conventionally designed and proportioned vessel of FIG. 1 should run aground, or strike a submerged feature, and, thereby, suffer gashing, puncturing or peeling-back damage not only to one or more sites on the bottom wall 14 of its outer hull, but also (though perhaps to a spatially lesser extent), on the bottom wall 26 of its inner hull 24, the integrity of one or more of its cargo tanks 38 will be disrupted from below.

The first reaction of one totally unfamiliar with such an occurrence may be that, when such an event occurs, seawater will rush in through the breach in the hulls, perhaps by analogizing to a known experience when a rowboat has sprung a leak. In the dynamics of such a situation, some seawater might enter. However, in the usual event, because of the hydrostatic effect of the portion of the cargo carried above the sea level indication in FIG. 1, and the fact that crude oil is lighter (lower in specific gravity) than seawater, if the outer and inner-bottom walls were to be breached, as indicated at 52, 54 in FIG. 2, crude oil flowing down through the breach 54 in the inner-hull-bottom wall, will flow laterally and upwards within the associated compartment 50, filling the associated compartment to an oil equilibrium level 56, which is of equal vertical height in both cargo tank and surrounding compartments.

One should not presume that further vessel sinkage will take place after breaching of bottom side inner and outer hulls of a double hull tanker. In fact, minor sinkage may occur if the oil is retained on board and there is ingress of seawater (which would, in any event, probably stratify below the oil inside the ship). This is more likely to occur when the ship is carrying relatively low specific gravity oil, but the sinkage is irrelevant to whether or not the oil is retained by hydrostatic balance. Conversely, it is entirely possible that for the tanks not designed in accordance with the invention, oil will actually leak from the ship before hydrostatic balance takes place, in which case, the ship might rise out of the water somewhat without any ingress of seawater occurring. Or, for that matter, under the right circumstances, hydrostatic balance might occur at precisely the point when the first drop of oil is ready to leak from the ship and the ship's draft would be unchanged.

At equilibrium, a balance has also been reached as to how far the oil will rise in the surrounding compartments versus how far the vessel will sink in the sea.

In the conventionally sized and proportioned double-bottomed oil tanker of FIGS. 1 and 2, there is insufficient lowly positioned space in the respective compartment or compartments 50 to accommodate all of the crude oil contained above the oil equilibrium level 56 within the breached cargo tank or tanks. Accordingly, once the oil flowing out of the breached tank into the associated compartment fills the compartment to the equilibrium level, there is still some oil remaining in the cargo tank above the equilibrium level 56. In FIG. 2, this quantum of compartmentally non-containable oil is labeled AMOUNT OF OIL WHICH WILL BE SPILLED. It is also designated by the numeral 58.

If FIG. 1 were a 'still' or one frame from a video being made of a tanker that had gone aground, and more of the video were to be shown, what the viewers would next see, is crude oil beginning to flow in quantity (even though not necessarily at a uniform flow rate), out of the cargo tank through the breach 54, downward across the thickness compartment 50, out into the ocean through the breach 52, and up to sea level 46 around the vessel 10, forming a layer or slick.

The underlying concept of the present invention is to proportion the design of the kind of tanker that has been described hereinabove with reference to FIGS. 1 and 2, so that, novelly, there is sufficient lowly positioned space within the confined space 50 of the or each cargo tank-associated compartment, to compartmentally contain all of the oil that would flow downwards out of the associated cargo tank should the cargo tank be breached through the bottom. By "lowly positioned", it is meant that such space is located below the level to which the upper surface of the cargo can be expected to sink, should the vessel bottom be breached through both hulls.

In FIG. 3, a double-hulled tanker designed and constructed in accordance with the principles of the present invention is depicted. Its features are given the same numerals as are used above in the description of FIGS. 1 and 2, but primed.

Given the highest expected specific gravity of crude oil in a fully loaded cargo tank and the lowest expected specific gravity of seawater, which would exist with the vessel afloat at its maximum allowable operating draft, it can be expected that if the inner and outer hulls of each cargo tank of the tanker 10' were breached through the bottom, crude oil would flow out of each so-breached cargo tank, until the level of crude oil in both the breached cargo tank and the surrounding compartment(s) reaches equilibrium at a vertical distance above the vessel's lowermost bottom wall 44, which is less than 111 percent of its maximum allowable operating draft. (One hundred percent multiplied by 100 over 90 (the least favorable ratio of seawater-to-crude oil specific gravities) equals 111 percent. For lower specific gravity cargos or higher specific gravity seas, the ratio will be higher, which is more favorable for minimizing the volume of oil which will leak from the cargo tank if it is breached, which would be obvious to practitioners of the art. And, regardless of the ratio, as long as the ratio exceeds 111 percent, the basic principle, as explained above, remains the same, that of accommodating within the bottom-breached compartments, substantially all of the oil that would otherwise flow out.

Figure 4:
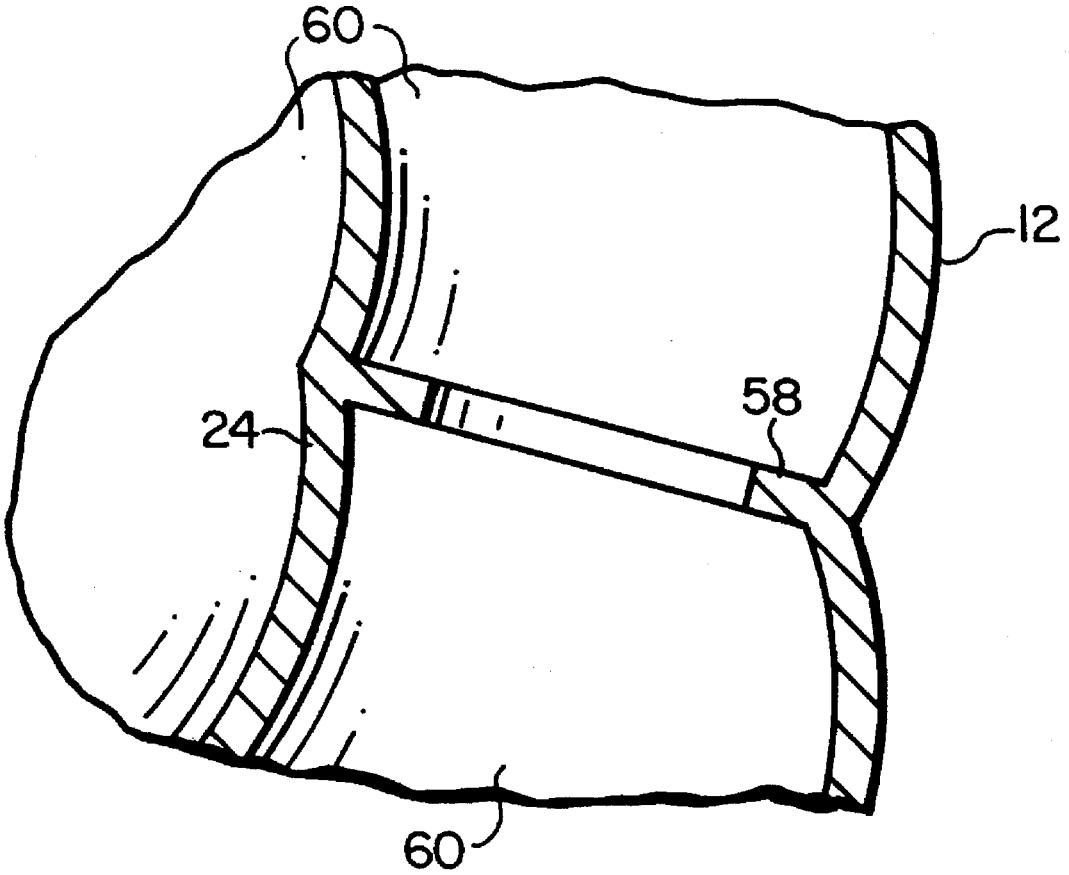
FIG. 4 is a fragmentary larger scale, transverse cross-sectional view of the tanker, showing a generalized hull structure including inner and outer hull walls, an inter-hull longitudinal connecting plate and a transverse bulkhead.

FIG. 4 is a fragmentary larger scale, transverse cross-sectional view of the tanker of FIGS. 1–3, showing generally (based on the prior art sources cross-referenced hereinabove), a double hull structure including an inner hull 24, an outer hull 12, an interhull connecting plate 58, and a transverse bulkhead 60.

It should now be apparent that the apparatus and method for accommodating leaked oil within a double-hulled tanker after suffering grounding damage as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A double-hulled oil tanker, comprising:

wall structure defining an outer hull having a bottom wall, opposed sidewalls and a deck, and an inner hull having a bottom wall, sidewalls and transitional structure functionally interconnecting the outer and inner hulls and providing at least one cargo tank surrounded by at least one interhull compartment on at least its bottom and on at least each side thereof which is contiguous with a respective said inner hull sidewall;

said tanker having a maximum allowable operating draft, at which respective first portions of the height of said vessel, the volume of said cargo tank, and the volume of said interhull compartment are disposed below sea level as experienced by said tanker when said at least one cargo tank thereof is laden with crude oil having a specific gravity which is no greater than 0.9, and respective second portions thereof are disposed above sea level and said interhull compartment is substantially empty;

said cargo tank having a volume above a level equal to 111 percent of said maximum allowable operating draft which is less than the volume below that same level, of said interhull compartment.

2. The double-hulled oil tanker of claim 1, wherein:

there is only one said cargo tank and only one said interhull compartment.

3. The double-hulled oil tanker of claim 1, wherein:

each said cargo tank is provided in a longitudinal midbody portion of said tanker.

4. The double-hulled oil tanker of claim 3, wherein:

each said cargo tank and respective compartment is delimited at fore and aft extents thereof by respective transverse bulkheads.

5. A method for containing an oil spill from a double-hulled tanker when the tanker, while each cargo tank thereof is filled with oil runs aground so severely as to breach at least one said cargo tank thereof through bottom walls of outer and inner hulls thereof, comprising:

providing such sufficient lowly placed empty interhull compartment space between outer and inner hulls of said vessel, that as oil flows out of each breached cargo tank, until reaching an equilibrium level, substantially all of said oil flowing out is accommodated in said lowly placed interhull compartment space.

* * * * *